US011355078B2

(12) United States Patent
Kang

(10) Patent No.: US 11,355,078 B2
(45) Date of Patent: Jun. 7, 2022

(54) DISPLAY PANEL DRIVING METHOD, DRIVING SYSTEM AND DISPLAY DEVICE

(71) Applicant: HKC CORPORATION LIMITED, Shenzhen (CN)

(72) Inventor: Chih Tsung Kang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/042,880

(22) PCT Filed: Mar. 11, 2019

(86) PCT No.: PCT/CN2019/077603

§ 371 (c)(1),
(2) Date: Sep. 28, 2020

(87) PCT Pub. No.: WO2020/118926

PCT Pub. Date: Jun. 18, 2020

(65) Prior Publication Data

US 2021/0027731 A1 Jan. 28, 2021

(30) Foreign Application Priority Data

Dec. 11, 2018 (CN) ..... 201811510627.6
Dec. 11, 2018 (CN) ..... 201811511896.4

(51) Int. Cl.
*G09G 5/10* (2006.01)
*G09G 3/36* (2006.01)

(52) U.S. Cl.
CPC ... *G09G 3/3607* (2013.01); *G09G 2320/0242* (2013.01); *G09G 2320/0666* (2013.01); *G09G 2340/06* (2013.01)

(58) Field of Classification Search
CPC .... G09G 3/3607; G09G 3/3413; G09G 3/342; G09G 3/2074; G09G 3/2044;
(Continued)

(56) References Cited

U.S. PATENT DOCUMENTS

2010/0079479 A1* 4/2010 Kurokawa ..... G09G 1/002 345/590
2010/0091034 A1* 4/2010 Matsumoto ..... H04N 1/603 345/601
2012/0293530 A1* 11/2012 Mosle ..... G06T 11/001 345/589

FOREIGN PATENT DOCUMENTS

CN 101115211 A 1/2008
CN 101866641 A 10/2010
(Continued)

OTHER PUBLICATIONS

Wenfei Li, the ISA written comments, Aug. 2019, CN.
Wenfei Li, the International Search Report, Aug. 2019, CN.

*Primary Examiner* — Jennifer T Nguyen

(57) ABSTRACT

The present disclosure discloses a display panel driving method, a driving system and a display device, includes steps: receiving the first color signals, converting the first color signals into the first color space signals; obtaining a current color saturation signal, determining whether the current color saturation signal is in an adjusting color adjustment interval, if the current color saturation signal is in the adjusting color adjustment interval, obtaining the predetermined adjustment coefficients; adjusting and processing the current color saturation signal to receive a second color space signals; converting the second color space signals into the second color signals in the RGB system to drive a display pane.

16 Claims, 5 Drawing Sheets

(58) Field of Classification Search
CPC ..... G09G 3/3266; G09G 2310/0286; G09G 2320/0242; G09G 2320/0666; G09G 2340/06; G09G 2360/16; G09G 5/06
USPC ..... 345/690
See application file for complete search history.

(56) References Cited

FOREIGN PATENT DOCUMENTS

| | | | |
|---|---|---|---|
| CN | 102479482 | A | 5/2012 |
| CN | 103634580 | A | 3/2014 |
| CN | 103974051 | A | 8/2014 |
| CN | 106981277 | A | 7/2017 |
| JP | 2009302906 | A | 12/2009 |
| KR | 20160137215 | A | 11/2016 |

* cited by examiner

DISPLAY PANEL DRIVING METHOD, DRIVING SYSTEM AND DISPLAY DEVICE

The present application claims foreign priority to Chinese Patent Application No. CN201811510627.6, titled: DISPLAY PANEL DRIVING METHOD, DRIVING SYSTEM AND DISPLAY DEVICE, filed on Dec. 11, 2018 in the State Intellectual Property Office of China and foreign priority to Chinese Patent Application No. CN201811511896.4, titled: DISPLAY PANEL DRIVING METHOD. DRIVING SYSTEM AND DISPLAY DEVICE, filed on Dec. 11, 2018 in the State Intellectual Property Office of China. The entire contents of which is hereby incorporated by reference.

TECHNICAL FIELD

The present disclosure relates to a field of display panel technology, and in particular, to a display panel driving method, driving system and a display device.

BACKGROUND

The statements herein merely provide background information related to the present disclosure and do not necessarily constitute the prior art.

With the development and advancement of technology, Liquid Crystal Displays (LCDs) have become mainstream products of displays because of their thin bodies, low power consumption, and low radiation, and have been widely used. The liquid crystal displays on markets mostly are backlight type liquid crystal displays, include liquid crystal panels and backlight modules. A working principle of the liquid crystal panel is that liquid crystal molecules are arranged between two parallel glass substrates, and a driving voltage is applied to the two glass substrates to control rotating direction of the liquid crystal molecules, so as to refract light rays of the backlight module to generate images.

The present large-size liquid crystal display panel mostly adopts a Vertical Alignment (VA) liquid crystal technology or an In-Plane Switching (IPS) liquid crystal technology. Compared with the IPS liquid crystal technology, the VA liquid crystal technology has the advantages of high producing efficiency and low manufacturing cost, but there is an obvious optical property defect in the optical property. To be specific, some large-size display panels, especially a VA type liquid crystal drive, is rapidly saturated along with a driving voltage in large-visual-angle brightness, which makes a visual image quality contrast and a color deviation deteriorate seriously compared with a front view image quality, that is to exist a large-visual-angle color deviation.

SUMMARY

The present disclosure provides a display panel driving method, a driving system and a display device to adjust an intensity of the light sources to improve color deviation.

To achieve the above objective, the present disclosure provides a display panel driving method, includes steps:

receiving first color signals in an Red-Green-Blue (RGB) system, converting the first color signals into the first color space signals in an Hue-Saturation-Value (HSV) system;

obtaining a current color saturation signal of the first color space signals; determining whether a hue of the current color saturation is in an adjusting color adjustment interval or not; and if the hue of the current color saturation is in the adjusting color adjustment interval, obtaining the predetermined adjustment coefficients corresponding to the current color saturation signal;

adjusting and processing the current color saturation signal by the predetermined adjustment coefficients;

accomplishing the step of adjusting and processing the current color saturation signal to obtain the second color space signals under the HSV system; and converting the second color space signals into the second color space signals in the RGB system to drive the display panel.

Optionally, the step of adjusting and processing the current color saturation signal by the predetermined adjustment coefficients includes:

adjusting and processing a color saturation value of all the color saturation signals in the adjusting color adjustment interval according to the predetermined adjustment coefficients.

Optionally, the step of adjusting and processing the current color saturation signal by the predetermined adjustment coefficients includes:

reducing the color saturation value of the color saturation signals in the adjusting color adjustment interval according to the predetermined adjustment coefficients.

Optionally, the color saturation signals are divided into at least a first hue interval, a second hue interval, a third hue interval, and a non-adjusting hue interval according to the different hue;

determining whether the hue of the current color saturation signal is in the adjusting color adjustment interval, if the hue of the current color saturation signal is in the adjusting color adjustment interval, the step of obtaining the predetermined adjustment coefficients corresponding to the current color saturation signal is as follow:

determining whether the hue corresponding to the current color saturation signal is in the first hue interval, the second hue interval, or the third hue interval, if the hue corresponding to the current color saturation signal is in the first hue interval, the second hue interval, or the third hue interval, obtaining the predetermined adjustment coefficients corresponding to the first hue interval, the second hue interval, and the third hue interval;

determining that the current saturation signal is not in a hue interval to be adjusted if the current color saturation signal is in the non-adjusting hue interval; then not adjusting and processing the corresponding color saturation signal or performing the predetermined adjustment coefficients as one.

Optionally, the first hue interval is a red hue interval, the second hue interval is a green hue interval, and the third hue interval is a blue hue interval;

when the color saturation signals are in the same hue, the color saturation value is greater, correspondingly, an adjusting amplitude of adjustment and processing is greater.

Optionally, in the step of obtaining the predetermined adjustment coefficients corresponding to the first hue interval, the second hue interval, and the third hue interval:

corresponding to the first hue interval, the second hue interval, and the third hue interval, the predetermined adjustment coefficients of the color saturation signals with the same color saturation value are different.

Optionally, the color saturation signals are divided into the red hue interval, the green hue interval, the blue hue interval, and the non-adjusting hue interval according to the different hue intervals;

a range of a hue is: 0-360, corresponding to 0-360 degrees, in which:

the hue satisfied with following formula is the red hue interval: 0≤Hue<40 or 320<Hue≤360;

the hue satisfied with following formula is the green hue interval: 80<Hue<160;

the hue satisfied with following formula is divided as the blue hue interval: 200<Hue<280: and the hue satisfied with following formula is the non-adjusting hue interval: 40≤Hue≤80, or 160≤Hue≤200, or 280≤Hue≤320.

Optionally, the predetermined adjustment coefficients are obtained through calculating according to a predetermined calculating formula or searched through an adjusting coefficient look-up table.

Optionally, the adjusting coefficient look-up table is a look-up table directly recording the predetermined adjustment coefficients or a look-up table recorded the coefficients of the predetermined calculating formula.

Optionally, the second color space signals and the first color space signals are matched as following formula:

$$S'=a*S4+b*S3+c*S2+d*S+e;$$

S is the current color saturation signal corresponding to the first color space signals and S' is the color saturation signal corresponding to the second color space signals; the a, b, c, d, and e are constant; the a, b, c, d, and e are searched by a predetermined formula coefficient look-up table according to the differences of the color saturation value and the hue interval.

Optionally, if the color saturation signals are divided into at least the first hue interval, the second hue interval, the third hue interval, and the non-adjusting hue interval according to the different hue, the steps of obtaining the predetermined adjustment coefficients corresponding to the first hue interval, the second hue interval, and the third hue interval includes:

determining whether the hue corresponding to the current color saturation signal is in the red hue interval, the green hue interval and the blue hue interval, if the hue corresponding to the current color saturation signal is in the red hue interval, the green hue interval and the blue hue interval, determining the hue corresponding to the current color saturation signal is in the adjusting color adjustment interval; and determining whether the color saturation value of the color saturation signal in the adjusting color adjustment interval reaches a predetermined threshold; if the color saturation value of the color saturation signal in the adjusting color adjustment interval reaches the predetermined threshold, obtaining the predetermined adjustment coefficients corresponding to current color saturation according to the hue interval and the color saturation value.

Optionally, in the step of determining whether the color saturation value of the current color saturation signal reaches a predetermined color saturation threshold;

the color saturation threshold is 0.5; if the color saturation value of the current color saturation signal is bigger than 0.5, then judging the color saturation value of the current color saturation signal reaches the predetermined color saturation threshold.

Optionally, if the color saturation value of the current color saturation signal is smaller than or equal to 0.5, then determining the color saturation value of the current color saturation signal does not reach the predetermined color saturation threshold; not adjusting or processing the corresponding color saturation signal or performing the predetermined adjustment coefficients as one.

Optionally, the predetermined color saturation threshold is from 0.5 to 1 and does not include 0.5 and 1.

Optionally, S is regarded as the current color saturation signal corresponding to the first color space signals; S' is regarded as the color saturation signal corresponding to the second color space signals; H is regarded as the predetermined adjustment coefficients; then: S'=S*H.

The present disclosure further provides a display panel driving system, includes:

a receiving circuit, predetermined adjustment coefficients calculating circuit, an adjusting circuit and a driving circuit;

the receiving circuit receiving the first color signals in the Red-Green-Blue (RGB) system and converting the first color signals into the first color space signals in the Hue-Saturation-Value (HSV) system; the predetermined adjustment coefficients calculating circuit obtaining a current color saturation signal of the first color space signals and determining whether the hue of the current color saturation signal is in the adjusting color adjustment interval; if the hue of the current color saturation signal is in the adjusting color adjustment interval, then obtaining the predetermined adjustment coefficients corresponding to the current color saturation signal The adjusting circuit adjusting and processing the current color saturation signal by the predetermined adjustment coefficients; completing the adjustment and processing of the color saturation signal, achieving the second color space signals under the HSV system; and the driving circuit, converting the second color space signals into the second color signals in the RGB system to drive the display panel, The present disclosure further provides a display device, includes the display panel driving system. The display panel driving system includes the receiving circuit, the predetermined adjustment coefficients calculating circuit, the adjusting circuit and the driving circuit;

the receiving circuit receiving the first color signals in the Red-Green-Blue (RGB) system and converting the first color signals into the first color space signals in the Hue-Saturation-Value (HSV) system; the predetermined adjustment coefficients calculating circuit obtaining a current color saturation signal of the first color space signals and determining whether the hue of the current color saturation signal is in the adjusting color adjustment interval; if the hue of the current color saturation signal is in the adjusting color adjustment interval, then obtaining the predetermined adjustment coefficients corresponding to the current color saturation signal The adjusting circuit adjusting and processing the current color saturation signal by the predetermined adjustment coefficients: completing the adjustment and processing of the color saturation signal, achieving the second color space signals under the HSV system; and the driving circuit, converting the second color space signals into the second color signals in the RGB system to drive the display panel.

In the present disclosure, the color signals are based on the RGB color system and the color deviation of the color saturation signal in certain hue intervals is relatively serious. But in some other intervals, the color deviation is not serious and even belongs to an acceptable range. The present disclosure obtains the current saturation signal and divides the current saturation signal into one part inside the adjusting color adjustment interval and another part outside the adjusting color adjustment interval according to the difference of corresponding hues. The color saturation signal correspondingly located in the adjusting color adjustment interval obtains corresponding predetermined adjustment coefficients of the current color saturation signal, and performs a color saturation adjustment. Therefore, the color saturation signal with a severe color deviation is controlled in a region with a non-severe color deviation to improve the color deviation. For the color saturation signal outside the hue interval to be adjusted with the non-severe color deviation, adjusting amplitude can be reduced or even not adjusted. So that when the color deviation is improved the color saturation adjustment is reduced as much as possible to avoid an excessive damage caused by the color saturation and receive a balance of the color deviation and the color saturation, and the display effect is improved. Moreover, the present disclosure is not based on sacrificing a light-transmitting opening area, so that the reduction of a light transmittance and the enhancement of a production cost are avoided.

BRIEF DESCRIPTION OF DRAWINGS

The drawings are included to provide a further understanding of embodiments of the present disclosure, which form portions of the specification and are used to illustrate implementation manners of the present disclosure and are intended to illustrate operating principles of the present disclosure together with the description. Apparently, the drawings in the following description are merely some of the embodiments of the present disclosure, and those skilled in the art are able to obtain, other drawings according to the drawings without contributing any inventive labor. In the drawing.

DETAILED DESCRIPTION OF EMBODIMENTS

Specific structure and function details disclosed herein are only representative and are used for the purpose of describing exemplary embodiments of the present disclosure. However, the present disclosure may be achieved in many alternative forms and shall not be interpreted to be only limited to the embodiments described herein.

The present disclosure is further described in the following with reference to the accompanying drawings and the embodiments.

In a large-size liquid crystal display panel, especially in a Vertical Alignment (VA) type liquid crystal display panel, voltage rapidly saturates a corresponding wide viewing angle brightness, resulting in a sharp contrast and image quality color deviation from a wide viewing angle compared to the image quality from a front view.

Figure 1:
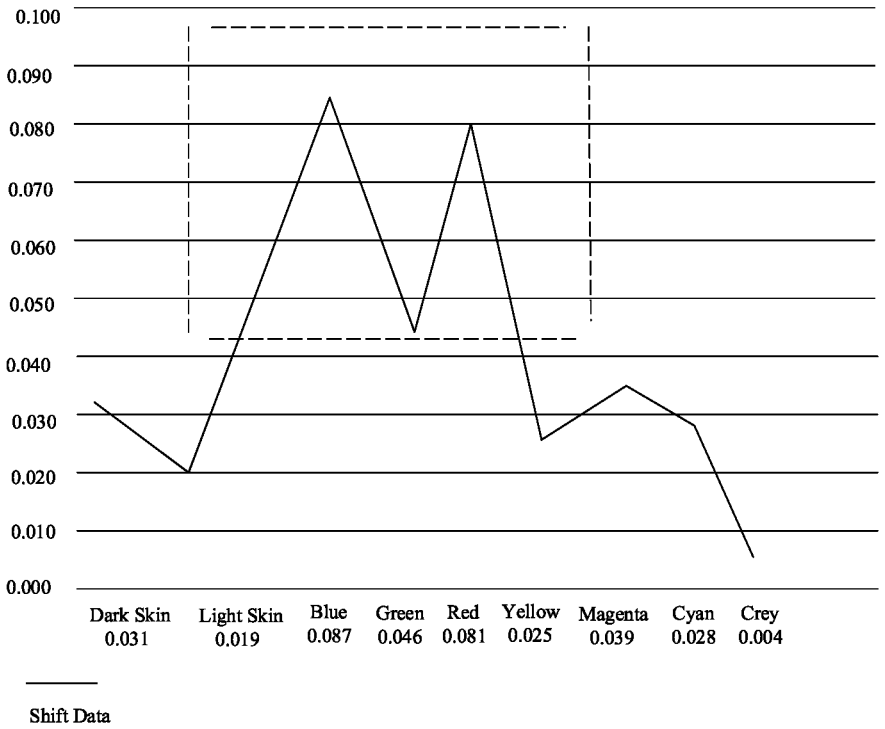
FIG. 1 is a schematic diagram of color deviation variations of a wide viewing angle and a front viewing angle of various representative color systems of a liquid crystal display.

FIG. 1 is a schematic diagram of color deviation variations of a wide viewing angle and a front viewing angle of various representative color systems of a liquid crystal display. As shown in FIG. 1, the ordinate indicates a degree of a color deviation, and it is obvious that the color deviation of R, G, and B hue is more severe than that of other colors. An exemplary solution is to divide the RGB (Red, Green, Blue) sub-pixels into main pixels/sub-pixels, so that an overall brightness viewed from wide viewing angle approaches the brightness viewed from a front viewing angle along with a variation of the voltage.

Figure 2:
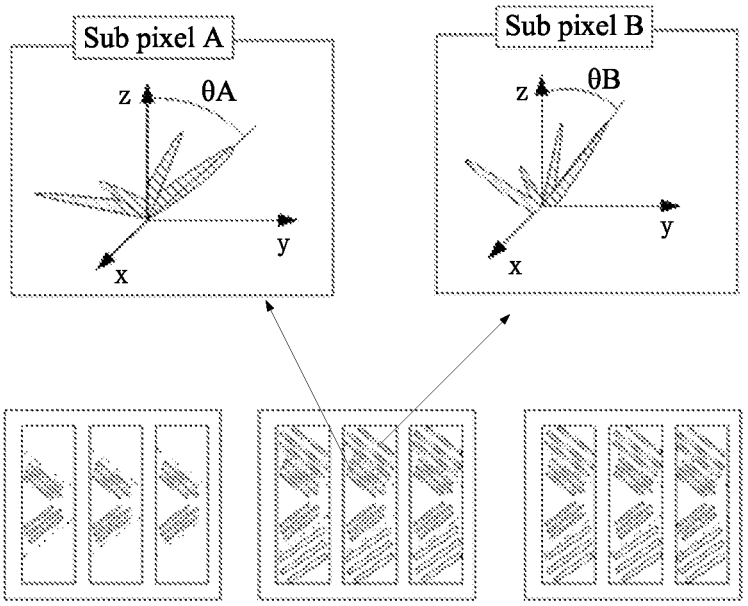
FIG. 2 is a first schematic diagram of dividing an original pixel into main pixels/sub-pixels in an exemplary scheme.
Figure 3:
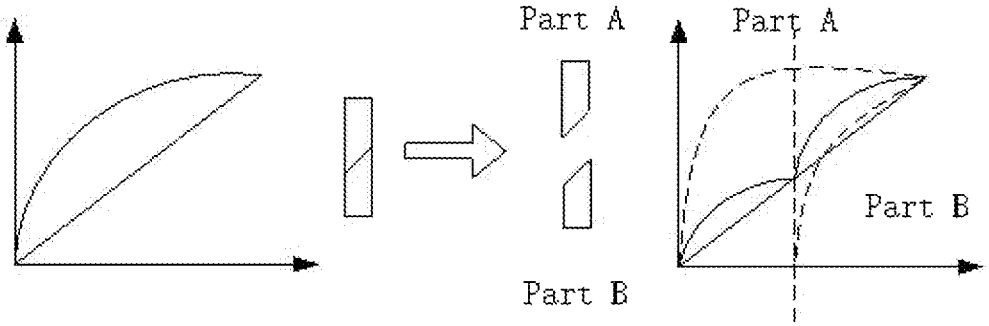
FIG. 3 is a second schematic diagram of dividing an original pixel into main pixels/sub-pixels in an exemplary scheme.

FIG. 2 is a first comparison diagram of non-distinguishing main pixels and sub-pixels and distinguishing main pixels and sub-pixels. FIG. 3 is a second comparison diagram of non-distinguishing main pixels and sub-pixels and distinguishing main pixels and sub-pixels. As shown in FIG. 2 and FIG. 3, the x coordinate, the y coordinate, and the z coordinate represent three directions of three-dimensional space respectively. The θA represents a pretilt angle of the main pixels at a large voltage, and θB represents a pretilt angle of the sub-pixels at a small voltage. The abscissa in FIG. 3 is a gray-scale signal, and the ordinate in FIG. 3 is a luminance signal. At a wide viewing angle, the brightness is rapidly saturated with the signal, leading to a large view color deviation (FIG. 3, the arc segment on the left side). Dividing the pixels into main pixels and the sub-pixels is able to improve the phenomenon of color deviation to some extent.

To be specific, the original signals are divided into main pixels and sub-pixels with large voltage and small voltage. The large voltage and the small voltage on the front view are configured to make original front signals to change along with a brightness variation. Part A of FIG. 3 shows that the brightness in the large voltage viewing from side changes along with the grayscales. Part B of FIG. 3 shows that the brightness in the small voltage viewing from side changes along with the grayscale, in this way, the brightness of the side view synthesis changes with the grayscale as the arc in the left side, which is closer to the line in the right side, which indicates the brightness viewing from the front viewing angle along with the grayscale. Thus, the brightness viewing from the side view approaches the brightness viewing from the front view, and the color deviation caused by viewing from different angles is improved.

The defect is solved by applying different driving voltages on the main pixels and sub-pixels in space. However, it is need to re-design metal wires or Thin Film Transistor (TFT) elements to drive, the sub-pixels, which sacrifices a light-transmissive opening region, affects a panel penetration rate, and directly improves costs of the backlight.

Figure 4:
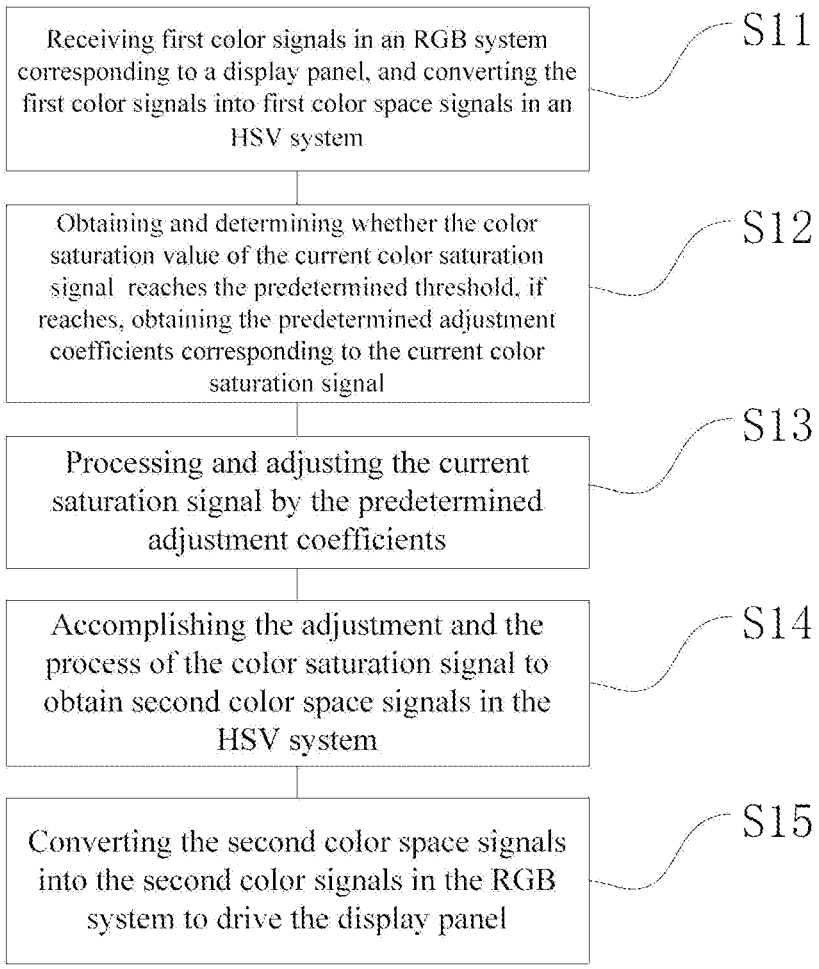
FIG. 4 is a flowchart of a display panel driving process according to one embodiment of the present disclosure.

Thus, the present disclosure provides a solution based on an improvement of different technical concepts, of which is as follows:

FIG. 4 is a flowchart of a display panel driving process according to one embodiment of the present disclosure, as shown in FIG. 4, the present disclosure discloses a display panel driving method, includes:

S11: receiving first color signals in an RGB system corresponding to a display panel, and converting the first color signals into first color space signals in an HSV system;

S12: obtaining a current color saturation signal of the first color space signals, determining whether the current color saturation signal is in the adjusting color adjustment interval. If the current color saturation signal is in the adjusting color adjustment interval, obtaining the predetermined adjustment coefficients corresponding to the current color saturation signal:

S13: processing and adjusting the current saturation signal by the predetermined adjustment coefficients;

S14: accomplishing the adjustment and the process of the color saturation signal to obtain second color space signals in the HSV system; and S15: converting the second color space signals into the second color signals in the RGB system to drive the display panel.

The driving system on which the driving method is applied is disposed at a front end of the display panel, specially disposed in a timing control chip of the display panel. The timing control chip further stores parameters such as the predetermined adjustment coefficient look up table related to the performance of the display panel corresponding to the driving system.

To be specific, receiving the first color signals in the RGB system;

obtaining the first color signals in the RGB system, obtaining the first color signals Rn_i, j, Gn_i, j, Bn_i, j, and converting each group of the RGB three primary color sub-pixel grayscale signals into the three primary color normalized luminance signals r, g, b, and obtaining the first normalized luminance signals rn_i,j,gn_i,j,bn_i,j after completing the conversion;

calculating the current color saturation signals according to the first normalized luminance signals by S=1−mini,j/maxi,j, and obtaining the predetermined adjustment coefficients H corresponding to the current color saturation signals S;

keeping maxi, j unchanged, and adjusting the mini, j by the predetermined adjustment coefficients H to obtain the second color saturation signals, and S'=1−mini,j*H/maxi,j;

converting the second color saturation signals S' into the second color signals in the RGB system to drive the display panel, and mini,j=min(rn_i,j, gn_i,j, bn_i,j), and maxi,j=max (rn_i,j gn_i,j, bn_i,j).

In the present disclosure, the color signals are based on the RGB color system and the color deviation of the color saturation signal in certain hue intervals is relatively serious. But in some other intervals, the color deviation is not serious and even belongs to an acceptable range. The present disclosure obtains the current saturation signal and divides the current saturation signal into one part inside the adjusting color adjustment interval and another part outside the adjusting color adjustment interval according to the difference of corresponding hues. The color saturation signal correspondingly located in the adjusting color adjustment interval obtains corresponding predetermined adjustment coefficients of the current color saturation signal and performs a color saturation adjustment. Therefore, the color saturation signal with a severe color deviation is controlled in a region with a non-severe color deviation to improve the color deviation. For the color saturation signal outside the hue interval to be adjusted with the non-severe color deviation, adjusting amplitude can be reduced or even not adjusted. So that when the color deviation is improved the color saturation adjustment is reduced as much as possible to avoid an excessive damage caused by the color saturation and receive a balance of the color deviation and the color saturation, and the display effect is improved. Moreover, the present disclosure is not based on sacrificing a light-transmitting opening area, so that the reduction of a light transmittance and the enhancement of a production cost are avoided.

In one or more embodiments, the step of adjusting and processing is to adjust and process a color saturation value of all the color saturation signals in the adjusting color adjustment interval according to the predetermined adjustment coefficients.

In this solution, the color saturation value of all the color saturation signals in the adjusting color adjustment interval is adjusted and processed according to the predetermined adjustment coefficients. Due to the color deviation of the color saturation signal in the hue interval to be adjusted is relatively serious, after the adjustment and the process, the color deviation is improved greatly. And performing the adjustment is convenient to control the balance of the color saturation of the signals. The display effect of the display panel is improved.

In one or more embodiments, the step of adjusting and processing is to reduce the color saturation value of the color saturation signals in the adjusting color adjustment interval according to the predetermined adjustment coefficients.

In this solution, in view of the fact that the color saturation in the adjustable hue interval have an equivalent color deviation. Based on the discovery in the same hue, the higher color saturation is, the more severe color deviation is, and reducing the color saturation value makes the color deviation lower. The adjusting operation of the color saturation value is to reduce the color saturation value of the color saturation signals in the adjusting color adjustment interval. In this way, the color saturation value of the second color signals in the RGB system is reduced. So that the color deviation is avoid. The color deviation is caused by the fact that the color saturation value of the corresponding color signals is too high. The color deviation is improved, particularly a large-view color deviation of the VA-type panel In one or more embodiments, the color saturation signals are divided into at least a first hue interval, a second hue interval, a third hue interval, and a non-adjusting hue interval according to the different hue;

determining whether the hue of the current color saturation signal is in the adjusting color adjustment interval, if the hue of the current color saturation signal is in the adjusting color adjustment interval, the step of obtaining the predetermined adjustment coefficients corresponding to the current color saturation signal is as follow:

determining whether the hue corresponding to the current color saturation signal is in the first hue interval, the second hue interval, or the third hue interval, if the hue corresponding to the current color saturation signal is in the first hue interval, the second hue interval, or the third hue interval, obtaining the predetermined adjustment coefficients corresponding to the first hue interval, the second hue interval, and the third hue interval;

determining that the current saturation signal is not in a hue interval to be adjusted if the current color saturation signal is in the non-adjusting hue interval; then not adjusting and processing the corresponding color saturation signal or performing the predetermined adjustment coefficients as one.

In one or more embodiments, if the color saturation signals are divided into at least the first hue interval, the second hue interval, the third hue interval, and the non-adjusting hue interval according to the different hue, the steps of obtaining the predetermined adjustment coefficients corresponding to the first hue interval, the second hue interval, and the third hue interval includes:

determining whether the hue corresponding to the current color saturation signal is in the red hue interval, the green hue interval and the blue hue interval, if the hue corresponding to the current color saturation signal is in the red hue interval, the green hue interval and the blue hue interval, determining the hue corresponding to the current color saturation signal is in the adjusting color adjustment interval; and determining whether the color saturation value of the color saturation signal in the adjusting color adjustment interval reaches a predetermined threshold;

if the color saturation value of the color saturation signal in the adjusting color adjustment interval reaches the predetermined threshold, obtaining the predetermined adjustment coefficients corresponding to current color saturation according to the hue interval and the color saturation value.

In this solution, the hue interval to be adjusted includes a red hue interval, a green hue interval and a blue hue interval. The changes of the color saturation value in each hue interval are different from the change relationships of the degree of the color deviation. The predetermined adjustment coefficients are obtained from respectively corresponding to the different hue intervals, hue value and color saturation value. The corresponding color saturation signals are adjusted in a targeted mode, so that a color deviation effect is greatly improved.

To be specific, only part of the color saturation signal is adjusted. The color saturation signal of this part needs to satisfy the hue interval firstly, and then satisfy the color saturation threshold also. In the same hue, although there are some color saturation signals located within an adjusting hue interval, the color saturation value is very low, the corresponding degree of the color deviation is within the acceptable range. And, due to the same hue, the larger color saturation value is, the more serious the color deviation is. For example, the color saturation signal locates in a blue main hue of a 240 degree hue, if the color saturation value is greater than 0.5, the color deviation is severely required to be adjusted, and if the color saturation value is less than 0.5, the color deviation is less severe and not required to be adjusted. Therefore, only the color saturation signal located in the hue interval to be adjusted is adjusted, and the color saturation value is more than the predetermined threshold. For example, the color saturation value is reduced, and the original color saturation value is kept without color deviation adjustment, so that not only the color deviation is improved, but also the color saturation is prevented from being reduced. The improvement of the display effect is facilitated.

In one or more embodiments, in the step of dividing the hue interval of the present disclosure, the first hue interval is the red hue interval, the second hue interval is the green hue interval, and the third hue interval is the blue hue interval;

the color saturation signals are in the same hue, the color saturation value is greater, correspondingly, the adjusting amplitude of adjustment and processing is greater.

In this solution, due to the same hue interval, particularly in the same hue, the color saturation signal value of the color saturation signal is higher, correspondingly, the color deviation is more serious; when the color saturation signals are in the same hue, the color saturation value is greater, correspondingly, the an adjusting amplitude of adjustment and processing is greater; therefore, the adjusting amplitude of the present disclosure for the signals with high color saturation is large, but the adjusting amplitude for the signals with low color saturation is small; the color saturation value of the color saturation signal is reduced and processed, a color saturation difference is reduced, and the color deviation caused by the high color saturation is avoided. Meanwhile, the color deviation caused by the high color saturation is avoided to achieve, so that a better effect of the color deviation is achieved. Certainly, the color saturation signal with low color saturation value is possible to be increased and processed, so that different color saturation signals are more uniform, and the color deviation is improved to a certain extent.

In addition, the adjustment amplitude herein refers to lower the amplitude of the color saturation signals. The larger the color saturation values, the corresponding predetermined adjustment coefficient may be smaller or larger according to different calculation formulas. However, an effect of the adjustment amplitude is constant. For example, if the predetermined adjustment coefficient is the coefficient of the overall color saturation signals, e. g. $S'=S*H$ (where S is the current color saturation signals and S' is the second color saturation signals, H is the predetermined adjustment coefficients), the greater the adjustment amplitude of lowering the value, the smaller the value of the predetermined adjustment coefficients. If the predetermined adjustment coefficient is the coefficient of one of the parameters of the color saturation signals, e. g. $S'=1-min*H/max$ (where S is the current color saturation signal, S' is the second color saturation signal, H is the predetermined adjustment coefficient, and min and max are the minimum and maximum values of the normalized luminance signals r, g, b when the RGB three primary color signals are converted into signals in the HSV system), the greater the adjustment amplitude of lowering the value, the greater the corresponding coefficient is. The larger the predetermined adjustment coefficient at this time, the larger the corresponding reduction adjustment amplitude is.

In one or more embodiments, in the step of obtaining the predetermined adjustment coefficients corresponding to the first hue interval, the second hue interval and the third hue interval;

corresponding to the first hue interval, the second hue interval and the third hue interval, the predetermined adjustment coefficient corresponding to the current color saturation signal with the same color saturation value are different.

In this solution, the color saturation signals based on different hue intervals has different color deviation degrees; in the case of the same color saturation value, parts of the hue intervals have severe color deviation, while parts of the hue intervals have light color deviation; for the hue intervals with the more obvious color deviation, the corresponding color saturation is adjusted to be low with a large amplitude; while for the hue intervals with the less obvious color deviation, the corresponding color saturation is adjusted to be low with a small amplitude; a better improvement of the color deviation is achieved; of course, for the hue interval with light color deviation, if the value is not reached the predetermined threshold, increasing the color saturation value to a certain extent is also possible.

Moreover, the color saturation signals based on different hue intervals has different color deviation degrees; in the case of the same color saturation value, parts of the hue intervals have severe color deviation, while parts of the hue intervals have light color deviation; corresponding to the RGB system. specifically, the color saturation signal of the blue hue interval is the most serious and the color saturation of the green hue interval is the lightest; in the embodiment, for the color saturation signal with the serious color deviation satisfied with the predetermined threshold, different predetermined adjustment coefficients are preset according to the different color deviation degrees.

To be specific, in the current color saturation signals having a same color saturation value, the adjustment amplitude of the predetermined color adjustment signals corresponding to the blue hue interval to the current color saturation signals is greater than the adjustment amplitude of the predetermined color adjustment signals corresponding to the red hue interval to the current color saturation signals; the adjustment amplitude of the predetermined color adjustment signals corresponding to the red hue interval to the current color saturation signals is greater than the adjustment amplitude of the predetermined color adjustment signals corresponding to the green hue interval to the current color saturation signals. In this way, the low-dimming amplitude of the signal with the highest color saturation value is the largest, the low-dimming amplitude of the signal with the minimum color saturation value is the minimum, and the color deviation caused by overlarge color saturation value is reduced, and the color saturation of the color saturation signals is more uniform. The color deviation is improved to a certain extent, so that the effect of the better color deviation improvement is achieved.

Moreover, taking S'=S*H as an example, the predetermined adjustment coefficients corresponding to the blue hue interval are smaller than the predetermined adjustment coefficients corresponding to the red hue interval, and the predetermined adjustment coefficients corresponding to the red hue interval are smaller than the predetermined adjustment coefficients corresponding, to the green hue interval. The smaller the predetermined adjustment coefficients, the larger the adjustment amplitude is. Correspondingly, taking S'=1−min*H/max as an example, the predetermined adjustment coefficients corresponding to the blue hue interval are the largest among the hue intervals and the adjustment amplitude is the largest, and the predetermined adjustment coefficients corresponding to the green hue interval are the smallest among the hue intervals and the adjustment amplitude is the smallest.

In one or more embodiments, the color saturation signals are divided into a red hue interval, a green hue interval, a blue hue interval, and an non-adjusting hue interval according to different hue intervals;

a hue ranges from 0-360, corresponding to 0-360 degrees, includes:

the hue of a hue interval satisfying a following formula is the red hue interval: 0≤Hue<40, or 320<Hue≤36;

the hue of the hue interval satisfying a following formula is the green hue interval: 80<Hue<160;

the hue of the hue interval satisfying a following formula is the blue hue interval: 200≤Hue≤280; and the hue of the hue interval satisfying the following formula is the non-adjusting hue interval: 40≤Hue≤80, or 160≤Hue≤200, or 280≤Hue≤320.

In this solution, in view of the RGB system, 0 degree is defined as a red hue. 120 degrees is defined as a green hue, and 240 degrees is defined as a blue hue. Under the premise of the same color saturation value, the closer to the red hue, the green hue, and the blue hue, the more severe the color deviation is. The farther away from the red hue, the green hue, and the blue hue, the lighter the color deviation of the color saturation signals is, and even the color saturation signals conform to the color deviation standard and does not need to be adjusted. In one or more embodiments, the hues close to the green hue is defined as the green hue interval, the hues close to the blue hue is defined as the blue hue interval, the hues close to the red hue is defined as a red hue interval, and the hues away from the red hue, the green hue, and the blue hue is defined as the unadjusted interval. Thus, corresponding to the same color saturation value, the predetermined adjustment coefficients of the blue hue interval having the most severe color deviation are set to be large, the predetermined adjustment coefficients of the green hue interval having the lightest color deviation are set to be small, and for the unadjusted hue interval where there is almost no color deviation, no adjustment is made, or the corresponding predetermined adjustment coefficients is set to be 1. In this way, the color deviation is improving, the decrease of the color saturation values are avoided, which is beneficial to improve the display effect of the display panel.

In one or more embodiments, in the step of determining whether the color saturation value of the current color saturation signal reaches a predetermined color saturation threshold:

the color saturation threshold is 0.5; if the color saturation value of the current color saturation signal is bigger than 0.5, then judging the color saturation value of the current color saturation signal reaches the predetermined color saturation threshold;

if the color saturation value of the current color saturation signal is smaller than or equal to 0.5, then determining the color saturation value of the current color saturation signal does not reach the predetermined color saturation threshold; not adjusting or processing the corresponding color saturation signal or performing the predetermined adjustment coefficients as one.

Moreover. the predetermined color saturation threshold is from 0.5 to 1 and does not include 0.5 and 1, when the current saturation signal is one, the second color saturation signal is not adjusted; of course, adjusting is also possible, the color saturation threshold is adjusted according to the requirements;

In this solution, due to the principle about the larger the color saturation value is, the larger the color deviation degree is, the color saturation is divided into a part of which the color saturation value meets the predetermined threshold and a part of which the color saturation value does not meet the predetermined threshold; specifically, setting the predetermined threshold to be 0.5, and doing so, and the color saturation signals with serious color deviation is selected for adjustment; the color saturation signal with light color deviation or even no color deviation does not need to be adjusted; the reduction of color saturation value is avoided as possible while the color deviation is improved; the balance of color deviation and color saturation is achieved, so that a better display effect is achieved.

Moreover, the predetermined adjustment coefficients are obtained through calculating according to a predetermined calculating formula or searched through an adjusting coefficient look-up table.

In this solution, the corresponding calculation formula or the corresponding adjustment coefficient lookup table is obtained through pre-test or calculation; and when the current color saturation signal is obtained, the color saturation signal is adjusted according to different color saturation values (color saturation values, hue intervals and the like), so that different predetermined adjustment coefficients are obtained, so that color saturation value adjustment operation of different degrees is carried out on the color saturation signals, so that the color deviation caused by much high color saturation value is reduced.

The predetermined adjustment coefficient look up table is a look up table directly recorded with predetermined adjustment coefficients or a look up table recording a predetermined calculation formula The second color space signals and the first color space signals conform to a following formula:

$$S'=a*S4+b*S3+c*S2+d*S+e;$$

S is the current color saturation signals corresponding to the first color space signals, and S' is the color saturation signal corresponding to the second color space signals. The a, b, c, d, e are constants, and the a, b, c, d, e are obtained by looking up in the predetermined formula coefficient look up table according to the different color saturation values and the different hue intervals.

In this solution, the predetermined adjustment coefficients are calculated according to the predetermined calculation formulas, and although the calculation formulas are different, it is generally satisfied with the fourth-order polynomial. The a, b, c, d, e are constants, and the a, b, c, d, e are obtained by looking up in the predetermined formula coefficient look up table according, to the different color saturation values and the different hue intervals. Of course. other calculation formulas are also applicable. For example, when the color saturation value S satisfies certain conditions, the predetermined adjustment coefficient is equal to the square root of S. When the color saturation value S satisfies another condition, the predetermined adjustment coefficient is equal to the cubic root of S.

Figure 5:
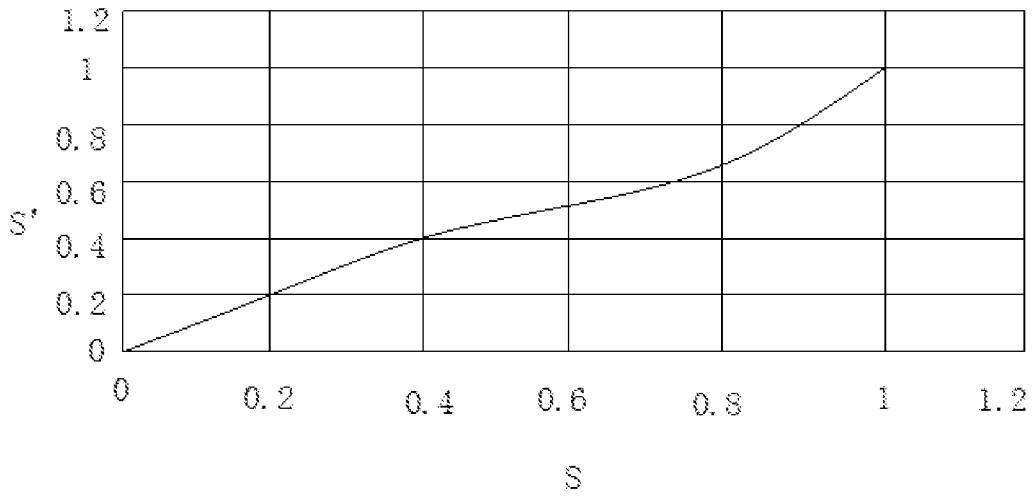
FIG. 5 is a schematic diagram of variations of a current color saturation signal and the second color saturation signal according to one embodiment of the present disclosure.
Figure 6:
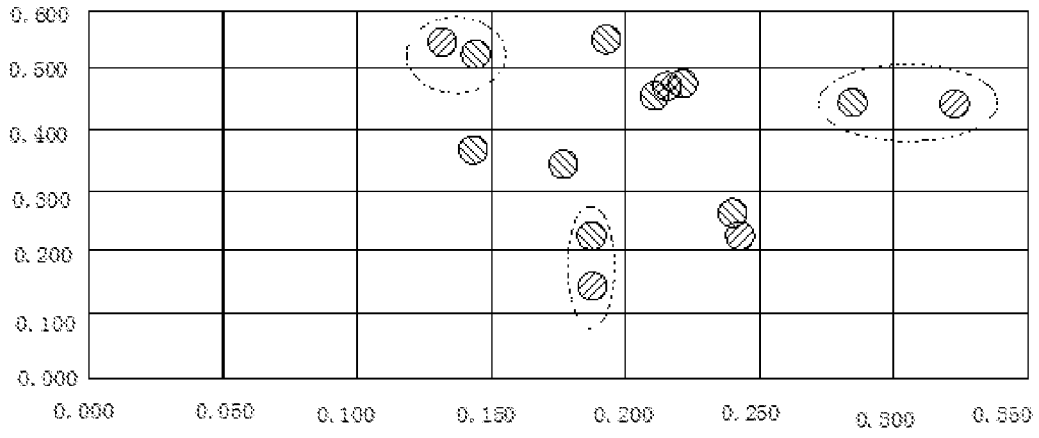
FIG. 6 is a graph showing aberration variations of the current color saturation signal and the second color saturation signal according to one embodiment of the present disclosure.
Figure 7:
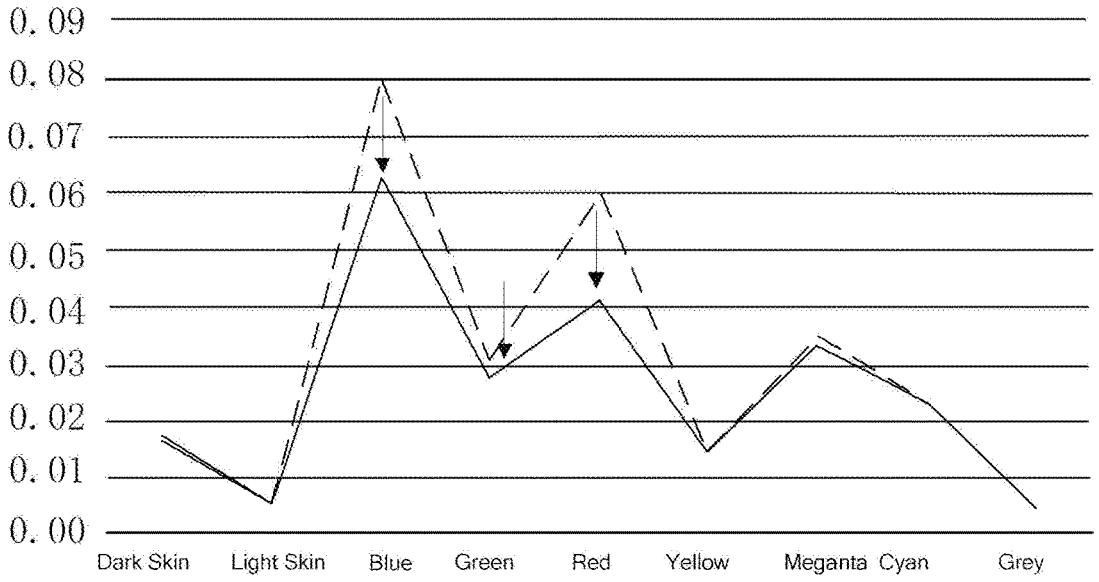
FIG. 7 is a schematic diagram of aberration variations of the current color saturation signal and the second color saturation signal according to one embodiment of the present disclosure.

FIG. 5 is a schematic diagram of variations of a current color saturation signal and the second color saturation signal according to one embodiment of the present disclosure. FIG. 6 is a graph showing aberration variations of the current color saturation signal and the second color saturation signal according to one embodiment of the present disclosure. FIG. 7 is a schematic diagram of aberration variations of the current color saturation signal and the second color saturation signal according to one embodiment of the present disclosure.

The color difference change chart of the FIG. 6 is under a condition of a positive view angle. Of course, it is also in the case of a side view angle. The dotted line in the FIG. 7 is the corresponding chromatic aberration change of the current color saturation signal under various color systems, and the solid line is the color difference change of the second color saturation signal under various color systems.

To be specific, the input signals of the display are RGB three primary color signals. If the display is driven by 8-bit color resolution, the tone of the RGB three primary color input signals are decomposed into 0, 1, 2 . . . 255 grayscale drive signals. In the present disclosure, the RGB three primary color signals are converted into HSV color space signals, and the color saturation is adjusted according to different hues and different color saturation values in the color space of the HSV to achieve the effect of the improvement of the color deviation.

Referring to FIG. 1, it shows the color deviation variations of a wide viewing angle and a front view of various representative color systems of the liquid crystal display. It is obvious that the color deviation of R, G, and B hues is more severe than that of other colors. Therefore, solving the color deviation of the R, G, and B hues is able to greatly improve the overall color deviation viewing from the wide viewing angle.

The calculation method of converting the color signals in the RGB system or the RGB three primary color signals into HSV signals is as follows:

the input signals of the RGB three primary colors are 8-bit grayscale digital signals of 0, 1, . . . 255, and each grayscale digital signal corresponding to the luminance normalized signal of the 255 input signals (the 255 grayscale is the maximum luminance) is r, g, b, respectively; where r=(R/255)^γr, g=(G/255)^γg, b=(B/255)^γb, where γr, γg, γb are gamma signals. and grayscale digital signals is converted into an exponential parameter of the luminance signal. H is a hue signal, and r, g, b normalized luminance signals are converted into a hue h and a saturation s signal. Among them, H is a color representation, which is represented by different degrees of hues from 0 degree to 360 degrees, where 0 degree is defined as red, 120 degrees is green, and 240 degrees is blue.

Where R is a red grayscale digital signal, G is a green grayscale digital signal, B is a blue grayscale digital signal. Where min is the minimum of r, g, b, and max is the maximum of r, g, b.

The conversion relationship between r, g, b normalized luminance signals and hue h, and the saturation signals conform to a following formula:

$$h=\begin{cases} 0^\circ & \text{if } \max=\min \\ 60^\circ\times\dfrac{g-b}{\max-\min}+0^\circ & \text{if } \max=r \text{ and } g\geq b \\ 60^\circ\times\dfrac{g-b}{\max-\min}+360^\circ & \text{if } \max=r \text{ and } g<b \\ 60^\circ\times\dfrac{b-r}{\max-\min}+120^\circ & \text{if } \max=g \\ 60^\circ\times\dfrac{r-g}{\max-\min}+240^\circ & \text{if } \max=b \end{cases}$$

$$s=\begin{cases} 0^\circ & \text{if } \max=0 \\ 1-\dfrac{\min}{\max}, & \text{otherwise} \end{cases}$$

In summary, when the hue is close to the R, G, B solid color hue, the color deviation deterioration of the wide viewing angle is more obvious. And when the hue is close to the R, G, B solid color hue, the greater the color saturation s, the more obvious the color deviation is. The color saturation s of the R, G, B solid color hues are lowered to improve the color viewed from the wide viewing angle comparing to the color viewed from the front view angel, that is, the closer to the solid color hue, the greater the adjustment amplitude is.

In addition, after completing the color saturation adjustment, a detection step is added. For example, converting the color saturation signals into the Commission Internationale De l'Eclairage Lu'v'color space signals, where L is a luminance coordinate and u' and v' are chroma coordinates. In order to improve the color deviation, the color saturation adjustment is to lower the color saturation values of the current color saturation signals, but if it is to reduce a loss of the color saturation, the solid color changes, that is, the current color saturation signals S are changed to the second color saturation signals S'. And the solid color change or the aberration Δuv should satisfy:

Δuv=√((u_1−u_2)^2+(v_1−v_2)^2)≤0.02. where u_1 and v_1 are the chroma coordinates of the current color saturation signal, and u_2 and v_2 are the chroma coordinates of the second color saturation signals which are the color saturation signal after the color saturation adjustment.

Figure 8:
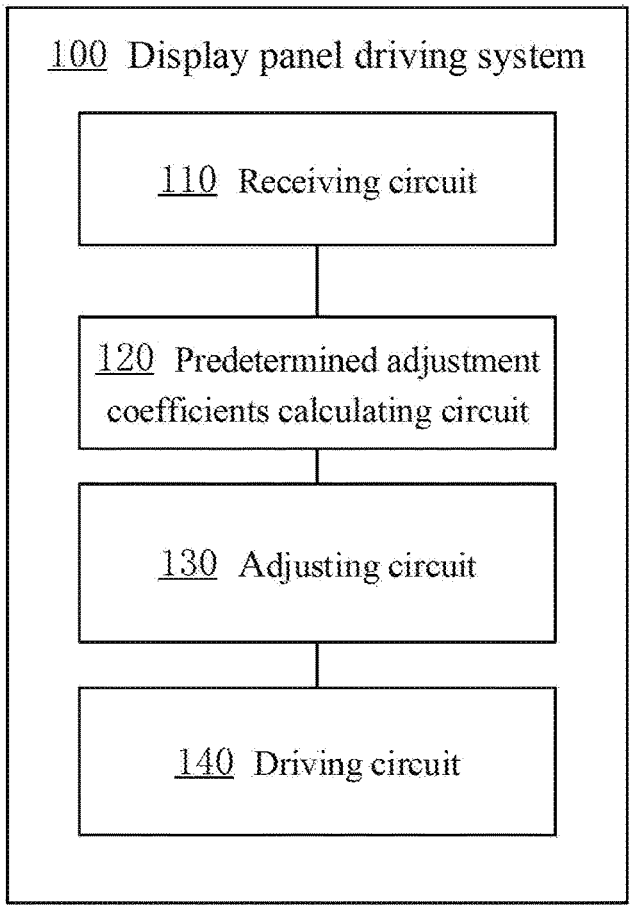
FIG. 8 is a schematic diagram of a driving system of a display panel according to one embodiment of the present disclosure.

FIG. 8 is a schematic diagram of a driving system of a display panel according to the present disclosure, refer to FIG. 8, and can be seen from FIG. 1 to FIG. 7: the present disclosure further discloses a display panel driving system 100, a display panel driving method according to the present disclosure is used, the driving system 100 includes:

a receiving circuit 110 receiving the first color signals in the Red-Green-Blue (RGB) system and converting the first color signals into the first color space signals in the Hue-Saturation-Value (HSV) system; a predetermined adjustment coefficients calculating circuit 120, an adjusting circuit 130 and a driving circuit 140;

the predetermined adjustment coefficients calculating circuit 120 obtaining a current color saturation signal of the first color space signals and determining whether the hue of the current color saturation signal is in the adjusting color adjustment interval; if the hue of the current color saturation signal is in the adjusting color adjustment interval, then obtaining the predetermined adjustment coefficients corresponding to the current color saturation signal; the adjusting circuit 130 adjusting and processing the current color saturation signal by the predetermined adjustment coefficients; completing the adjustment and processing of the color saturation signal, achieving the second color space signals under the HSV system; and the driving circuit 140, converting the second color space signals into the second color signals in the RGB system to drive the display panel.

Figure 9:
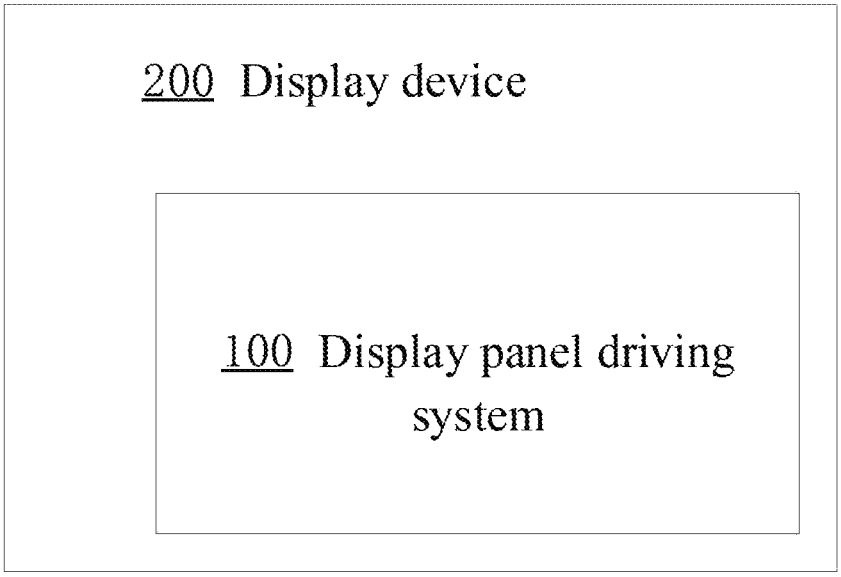
FIG. 9 is a schematic diagram of a display device according to one embodiment of the present disclosure.

FIG. 9 is a schematic diagram of a display device according the present disclosure, refer to FIG. 9, and can be seen from FIG. 1 to FIG. 8: the present disclosure further discloses a display device 200, includes the display panel driving system 100.

It should be noted that the limitation of each step involved in the present disclosure is not determined to limit the sequence of steps without affecting the implementation of the specific solution. Steps written in the foregoing can be executed first, or later, or even simultaneously as long as the specific solutions can be implemented, which should be considered as the scope of the present disclosure.

The present disclosure is able to be applied on various display panels, such as a Twisted-Nematic (TN) type display panel, In-Plane Switching (IPS) type display panel, a Vertical-Alignment (VA) type display panel, and Multi-domain Vertical Alignment (MVA) type display panel. Of course, the display panel can be other types of display panels which is able to be applied, such as a Organic Light-Emitting Diode (OLED) display panel.

The above content is a further detailed description of the present disclosure in conjunction with the specific optional embodiments, and the specific implementation of the present disclosure is not limited to the description. It will be apparent to those skilled in the art that a number of simple deductions or substitutions may be made without departing from the conception of the present disclosure, which should be considered as being within the scope of the present disclosure.

What is claimed is:

1. A display panel driving method, comprising following steps:

receiving first color signals in a Red-Green-Blue (RGB) system, converting the first color signals into the first color space signals in a Hue-Saturation-Value (HSV) system;

obtaining a current color saturation signal of the first color space signals; determining whether a hue of the current color saturation is in an adjusting color adjustment interval or not; and if the hue of the current color saturation is in the adjusting color adjustment interval, obtaining the predetermined adjustment coefficients corresponding to the current color saturation signal;

adjusting and processing the current color saturation signal by the predetermined adjustment coefficients;

accomplishing the step of adjusting and processing the current color saturation signal to obtain the second color space signals under the HSV system; and converting the second color space signals into the second color space signals in the RGB system to drive the display panel;

wherein the predetermined adjustment coefficients are obtained through calculating according to a predetermined calculating formula or searched through an adjusting coefficient look-up table;

wherein the second color space signals and the first color space signals satisfy the following formula:

$$S'=a\times S^4+b\times S^3+c\times S^2+d\times S+e;$$

wherein S is the current color saturation signal corresponding to the first color space signals and S' is the color saturation signal corresponding to the second color space signals; the a, b, c, d, and e are constant; the a, b, c, d, and e are searched by a predetermined formula coefficient look-up table according to the differences of a color saturation value and a hue interval.

2. The display panel driving method according to claim 1, wherein the step of adjusting and processing the current color saturation signal by the predetermined adjustment coefficients comprises:

adjusting and processing a color saturation value of all the color saturation signals in the adjusting color adjustment interval according to the predetermined adjustment coefficients.

3. The display panel driving method according to claim 1, wherein the step of adjusting and processing the current color saturation signal by the predetermined adjustment coefficients comprises:

reducing the color saturation value of the color saturation signals in the adjusting color adjustment interval according to the predetermined adjustment coefficients.

4. The display panel driving method according to claim 1, wherein the color saturation signals are divided into at least a first hue interval, a second hue interval, a third hue interval, and a non-adjusting hue interval according to the different hue;

determining whether the hue of the current color saturation signal is in the adjusting color adjustment interval, if the hue of the current color saturation signal is in the adjusting color adjustment interval, the step of obtaining the predetermined adjustment coefficients corresponding to the current color saturation signal is as follow:

determining whether the hue corresponding to the current color saturation signal is in the first hue interval, the second hue interval, or the third hue interval, if the hue corresponding to the current color saturation signal is in the first hue interval, the second hue interval, or the third hue interval, obtaining the predetermined adjustment coefficients corresponding to the first hue interval, the second hue interval, and the third hue interval.

5. The display panel driving method according to claim 4, wherein determining that the current saturation signal is not in a hue interval to be adjusted if the current color saturation signal is in the non-adjusting hue interval; then not adjusting and processing the corresponding color saturation signal or performing the predetermined adjustment coefficients as one.

6. The display panel driving method according to claim 4, wherein the first hue interval is a red hue interval, the second hue interval is a green hue interval, and the third hue interval is a blue hue interval;

when the color saturation signals are in the same hue, the color saturation value is greater, correspondingly, an adjusting amplitude of adjustment and processing is greater.

7. The display panel driving method according to claim 4, wherein in the step of obtaining the predetermined adjustment coefficients corresponding to the first hue interval, the second hue interval, and the third hue interval:

corresponding to the first hue interval, the second hue interval, and the third hue interval, the predetermined adjustment coefficients of the color saturation signals with the same color saturation value are different.

8. The display panel driving method according to claim 4, wherein, if the color saturation signals are divided into at least a first hue interval, a second hue interval, a third hue interval, and a non-adjusting hue interval according to the different hue, the steps of obtaining the predetermined adjustment coefficients corresponding to the first hue interval, the second hue interval, and the third hue interval comprises, determining whether the hue corresponding to the current color saturation signal is in a red hue interval, a green hue interval and a blue hue interval, if the hue corresponding to the current color saturation signal is in the red hue interval, the green hue interval and the blue hue interval, determining the hue corresponding to the current color saturation signal is in the adjusting color adjustment interval; and determining whether a color saturation value of the color saturation signal in the adjusting color adjustment interval reaches a predetermined threshold; if the color saturation value of the color saturation signal in the adjusting color adjustment interval reaches the predetermined threshold, obtaining the predetermined adjustment coefficients corresponding to current color saturation according to the hue interval and the color saturation value.

9. The display panel driving method according to claim 1, wherein the color saturation signals is divided into a red hue interval, a green hue interval, a blue hue interval, and a non-adjusting hue interval according to the different hue intervals;

a range of a hue value (hue) is: 0-360, corresponding to 0-360 degrees, wherein:

the hue value satisfied with following formula is the red hue interval: $0 \leq Hue < 40$ or $320 < Hue \leq 360$;

the hue value satisfied with following formula is the green hue interval: $80 < Hue < 160$;

the hue value satisfied with following formula is divided as the blue hue interval: $200 < Hue < 280$; and the hue value satisfied with following formula is the non-adjusting hue interval: $40 \leq Hue \leq 80$, or $160 \leq Hue \leq 200$, or $280 \leq Hue \leq 320$.

10. The display panel driving method according to claim 1, the adjusting coefficient look-up table is a look-up table directly recording the predetermined adjustment coefficients.

11. The display panel driving method according to claim 1, the adjusting coefficient look-up table is a look-up table recording coefficients of the predetermined calculation formula.

12. The display panel driving method according to claim 1, wherein in the step of determining whether a color saturation value of the current color saturation signal reaches a predetermined color saturation threshold:

the color saturation threshold is 0.5; if the color saturation value of the current color saturation signal is bigger than 0.5, then judging the color saturation value of the current color saturation signal reaches the predetermined color saturation threshold.

13. The display panel driving method according to claim 12, wherein if the color saturation value of the current color saturation signal is smaller than or equal to 0.5, then determining the color saturation value of the current color saturation signal does not reach the predetermined color saturation threshold; not adjusting or processing the corresponding color saturation signal or performing the predetermined adjustment coefficients as one.

14. The display panel driving method according to claim 12, wherein the predetermined color saturation threshold is from 0.5 to 1 and does not comprise 0.5 and 1.

15. A display panel driving system, comprising, a receiving circuit, receiving the first color signals in an Red-Green-Blue (RGB) system, converting the first color signals into the first color space signals in a Hue-Saturation-Value (HSV) system;

predetermined adjustment coefficients calculating circuit-, obtaining a current color saturation signal of the first color space signals; determining whether a hue of the current color saturation signal is in an adjusting color adjustment interval; if the hue of the current color saturation signal is in an adjusting color adjustment interval, then obtaining the predetermined adjustment coefficients corresponding to the current color saturation signal;

an adjusting circuit, adjusting and processing the current color saturation signal by the predetermined adjustment coefficients; completing the adjustment and processing of the color saturation signal, achieving the second color space signals under the HSV system; and a driving circuit, converting the second color space signals into the second color signals in the RGB system to drive the display panel;

wherein the predetermined adjustment coefficients are obtained through calculating according to a predetermined calculating formula or searched through an adjusting coefficient look-up table;

wherein the second color space signals and the first color space signals satisfy the following formula:

$$S' = a \times S^4 + b \times S^3 + c \times S^2 + d \times S + e;$$

wherein S is the current color saturation signal corresponding to the first color space signals and S' is the color saturation signal corresponding to the second color space signals; the a, b, c, d, and e are constant; the a, b, c, d, and e are searched by a predetermined formula coefficient look-up table according to the differences of a color saturation value and a hue interval.

16. A display device comprising a driving system, wherein the driving system comprises:

a receiving circuit, receiving the first color signals in an Red-Green-Blue (RGB) system, converting the first color signals into the first color space signals in a Hue-Saturation-Value (HSV) system;

predetermined adjustment coefficients calculating circuit, obtaining a current color saturation signal of the first color space signal; determining whether a hue of the current color saturation signal is in an adjusting color adjustment interval; if the hue of the current color saturation signal is in the adjusting color adjustment interval, then obtaining the predetermined adjustment coefficients corresponding to the current color saturation signal;

an adjusting circuit, adjusting and processing the current color saturation signal by the predetermined adjustment coefficients; completing the adjustment and processing of the color saturation signal, achieving the second color space signals in the HSV system; and a driving circuit, converting the second color space signals into the second color signals in the RGB system to drive the display panel;

wherein the predetermined adjustment coefficients are obtained through calculating according to a predetermined calculating formula or searched through an adjusting coefficient look-up table;

wherein the second color space signals and the first color space signals satisfy the following formula:

$$S'=a\times S^4+b\times S^3+c\times S^2+d\times S+e;$$

wherein S is the current color saturation signal corresponding to the first color space signals and S' is the color saturation signal corresponding to the second color space signals; the a, b, c, d, and e are constant; the a, b, c, d, and e are searched by a predetermined formula coefficient look-up table according to the differences of a color saturation value and a hue interval.

* * * * *